United States Patent [19]

Findlay

[11] 4,109,443

[45] Aug. 29, 1978

[54] METHOD AND APPARATUS FOR FORMING CONVOLUTE FOAM PACKAGE

[75] Inventor: Allen Cameron Findlay, Davidson, N.C.

[73] Assignee: Reeves Brothers, Inc., New York, N.Y.

[21] Appl. No.: 653,483

[22] Filed: Jan. 29, 1976

[51] Int. Cl.[2] ..... B65B 49/00; B65H 17/06; B65B 63/04

[52] U.S. Cl. ..... 53/118; 100/86; 242/56.8; 242/65

[58] Field of Search ..... 242/65, 66, 75.2, 55, 242/DIG. 3, 67.1, 56.8, 55.1; 53/118; 513/21 FW; 206/410, 417; 428/310, 906; 100/86, 76

[56] References Cited

U.S. PATENT DOCUMENTS

| | | | |
|---|---|---|---|
| 2,503,041 | 4/1950 | Greene | 242/55.1 X |
| 3,927,504 | 12/1975 | Forrister | 242/DIG. 3 X |

FOREIGN PATENT DOCUMENTS

| | | | |
|---|---|---|---|
| 46-10306 | 3/1971 | Japan | 100/76 |

*Primary Examiner*—George F. Mautz
*Attorney, Agent, or Firm*—Bell, Seltzer, Park & Gibson

[57] ABSTRACT

A method and apparatus for forming a convolute package of flexible foam sheet material which is highly compact to facilitate shipment and storage, and which has substantially uniform layer to layer compression. Further, the material in the package is dimensionally stable upon the unwinding of the package to permit the immediate use thereof, such as die stamping components of predetermined size therefrom. The package is produced by directing an advancing web into a nip formed between a take-up roller and a supporting roller and convolutely winding the web upon the take-up roller. The web is introduced onto the periphery of the package at the nip, and the package radius at the nip is maintained so as to be less than the radius of the remaining periphery of the package. In addition, the distance between the take-up roller and supporting roller is increased by a predetermined amount upon each rotation of the package to thereby achieve a substantially uniform layer to layer compression.

17 Claims, 14 Drawing Figures

METHOD AND APPARATUS FOR FORMING CONVOLUTE FOAM PACKAGE

The present invention relates to a method and apparatus for forming a highly impact convolute package of flexible foam sheet material which exhibits several surprising and novel physical characteristics, and wherein the layers in the package are substantially uniformly compressed. In this regard, the present invention represents an improvement of the invention described and claimed in the pending application of George A. Watson, Ser. No. 625,118, filed Oct. 23, 1975 and entitled "Convolute Foam Package and Method of Forming Same". Reference is also made to the present applicant's copending application entitled "Convolute Foam Package" Ser. No. 653,488, filed concurrently herewith, and now U.S. Pat. No. 4,003,469. These copending applications are commonly owned herewith, and are incorporated herein by reference.

In the manufacture of flexible foam sheet material, it is conventional to wind an elongate web of the material into a wound cylindrical roll as a final production step, and then to compress or densify the roll to reduce its bulk and thereby facilitate shipment and storage. In a heretofore widely used process, the cylindrical roll of foam is enclosed in an air tight plastic bag, and the air is then withdrawn from the bag to radially compress the roll and reduce its diameter. The bag is then sealed, and a non-extensible paper wrapper is positioned about the roll to serve as a binder for maintaining its compressed configuration. By use of this procedure, a reduction in the volume of the roll to approximately 30 to 40 percent of its original volume is possible, but the efficiency of the process is limited by reason of the fact that the resulting package usually has a non-uniform external configuration. More particularly, the vacuum not only compresses the roll radially, but also compresses its axially, thereby resulting in non-uniform enlargements at the ends of the package. The enlarged ends in turn limit the ability to closely group the resulting packages for transporation and/or storage, thereby decreasing the overall efficiency of the densification process.

The conventional vacuum forming procedure as described above has a further significant limitation in that wrinkles are formed in the foam layers which result from a gathering of the foam in both the length and width directions during the compaction process. These wrinkles tend to remain in the material for a period of time after the roll is unwound due to the hysteresis phenomenon. This recovery lag is particularly pronounced where the roll is maintained in compacted condition for an extended period, as where the roll is shippeed to a distant location, and the lag prevents the immediate use of the material in many instances, such as where it is desired to immediately die stamp critically dimensioned component parts from the web.

Another significant disadvantage of the above described vacuum forming process lies in the fact that the compressive forces exerted on the roll by the paper binder are substantial, and an accidental rupture of the binder results in an explosive release of these forces. As will be apparent, the potential for an explosive release of this type presents a serious safety hazard and could cause extensive damage, such as where the wound package is closely surrounded by similar packages during transit.

Another known method of densifying rolls of foam sheet material employs mechanical means for radially compressing the wound roll, after which a paper binder is wrapped and secured about the roll. This procedure does not tend to axially compress the roll, but it otherwise possesses the same limitations and disadvantages noted above with respect to the present vacuum process.

Still another procedure for reducing the bulk of highly elastic foam sheet material to facilitate its shipment and storage involves tensioning and stretching the material in the lengthwise direction as it is being wound into a roll, such that the material is wound in a thinned and stretched condition. This procedure is able to achieve a relatively high degree of densification, and the resulting package would not tend to explosively expand. However, the thus formed package is like a tightly wound coil spring, and would tend to immediately unwind when the circumferential binder is removed. Also, the stretching procedure results in a significant lengthening of the foam material in the longitudinal direction, as well as a reduction in its width in approximation with Poisson's ratio. Thus the package is difficult to handle even with a binder, and the material requires a significant period of time to return to its original dimensions after unwinding, which as noted above, precludes its immediate use in many instances. Further, the stretching procedure is not available for non-extensible materials, such as foam materials which have a relatively non-extensible scrim laminated thereto.

It has also been proposed to wind flexible foam sheet material on a machine which incorporates a pair of cradle rollers for supporting the foam roll therebetween during the winding process, and wherein pressure is exerted downwardly on the wound roll by a third roller riding on the upper surface of the roll. The three rollers employed in this apparatus are deeply grooved to permit the rollers to mesh at the start of the winding operation, with the grooves being about 2 inches wide and 2 inches deep. This winding apparatus is able to reduce the thickness of the foam layers possibly by as much as 25 percent, and thus it achieves a limited degree of compaction in the resulting wound package, but insofar as can be determined, the apparatus is not able to achieve that degree of compaction which is necessary to significantly reduce the volume of the package and thereby materially facilitate shipment and storage.

In the above referenced copending Watson application Ser. No. 625,118, the above described problems associated with the foam packages of the prior art are solved by the provision of a convolute package which comprises a predetermined length of highly compressible, flexible foam sheet material arranged in a plurality of convolute layers, and with the layers being substantially wrinkle-free and having a width dimension closely corresponding to the width of the material in unwound non-compacted form. The layers are compressed such that they have a thickness substantially less than three-quarters of the thickness of the non-compacted sheet material, and the volume of the package is substantially less than nine-sixteenths the volume the package would occupy in a non-compacted wound form.

The above package is produced in accordance with the method of the copending Watson application by advancing an elongate web of flexible foam sheet material into a nip formed between a take-up roller and a supporting roller, while winding the advancing web upon the take-up roller to form a wound package. The web is introduced onto the package at the nip while maintaining the package radius at the nip less than the radius of the remaining periphery of the package, and is compressed to reduce its thickness by substantially more than one-quarter of its original thickness as the web passes through the nip.

The package formed in accordance with the Watson application possesses several physical characteristics and properties which materially enhance its commercial utility. In particular, the package is substantially self-restrained against circumferential expansion and thus it does not tend to explosively expand upon the release of the wrapper or binder. Thus the handling and unwinding of the package is facilitated, and a serious safety hazard is avoided. Further, the package possesses only a limited tendency to unwind when the binding is released, such that in the event of an inadvertent release of the binder, tbhe package remains stationary and will neither roll along the floor or unwind in a spring-like fashion. Additionally, the foam layers in the package are substantially wrinkle free, and unchanged from their original length and width dimensions, such that when the package is unwound, the material is dimensionally stable in the length and width directions and may be immediately used in the formation of components of predetermined size without waiting for the hysteresis recovery which is associated with the prior art package as noted above.

While the package described in the copending Watson application is seen to provide a satisfactory solution to the above noted problems associated with the prior art foam packages, certain characteristics of the Watson package have prompted improvement efforts. In particular, since the density of the foam often varies from run to run, it is sometimes difficult to achieve package to package consistency in both the length of the foam wound in the package and the outer dimensions of the package. For example, where a less dense foam is wound, the degree of compression would be somewhat greater, and the outer diameter of the resulting package would be smaller for a given length of the foam than would be the case with a more dense foam. The specifications for both the length of the foam in the package and the outer dimensions thereof are often established by the customer or ultimate user, and in this regard, the outer dimensions are usually determined to permit maximum utilization of space within a railway car, truck trailer or the like. Thus, it is desirable to be able to maintain the specified outer dimensions from package to package for packages having a given length of foam therein, to assure proper packing during shipment and storage.

It is also desirable to have uniform layer to layer compression in packages of the described type when attempting to achieve a high degree of compression of the overall package. Otherwise, some layers in the package may be detrimentally over-compressed and other layers under-compressed. Such over-compression may result in a delayed recovery in the thickness of the foam upon the unwinding of the package, thereby precluding its immediate use in certain instances, such as where it is desired to sew a vinyl fabric layer or the like to one or both faces of the foam while the package is being unwound. In such cases, those areas of the resulting product corresponding to th over-compressed layers will be more thin than the remaining areas, since the sewing threads serve to maintain the reduced thickness of the foam. Further, the over-compression can result in a permanent collapse of the cellular structure within such layers to result in permanent variations in the thickness and appearance of the unwound foam.

It is accordingly an object of the present invention to provide a method and apparatus for forming a highly compact convolutely wound package of flexible foam sheet material and wherein the package has substantially uniform layer to layer compression within predetermined limits consistent with the desired compression of the overall package and without detrimental over-compression of any layers.

It is another object of the present invention to provide a method and apparatus for forming a highly compact convolutely wound package of flexible foam sheet material wherein the length of the foam sheet in the package and outside dimensions of the package may be consistently maintained from package to package.

It is a further object of the present invention to provide a method and apparatus for forming a convolute package of flexible foam sheet material which is significantly reduced in volume so as to materially facilitate shipment and storage, which is dimensionally stable in the length and width directions to permit use thereof immediately upon the unwinding of the package, and which is self-restrained against circumferential expansion and which has only a limited tendency to unwind.

These and other objects and advantages of the present invention are achieved in the embodiment illustrated herein by the provision of a method and apparatus which includes advancing an elongate web of flexible foam sheet material into a nip formed between a take-up roller and a supporting roller, and convolutely winding the advancing web upon the take-up roller to form a wound package. The web is introduced onto the package at the nip while maintaining the package radius at the nip less than the radius of the remaining periphery of the package, and is compressed to reduce its thickness by substantially more than one-quarter of its original thickness. In addition, compression of the package layers is maintained within predetermined limits which achieve the desired compression of the overall package and without detrimental over-compression of any layers by controlling the distance between the take-up roller and the supporting roller to a predetermined amount during the winding of the package upon the take-up roller.

Some of the objects of the invention having been stated, other objects will appear as the description proceeds, when taken in connection with the accompanying drawings, in which FIG. 1 is a schematic side elevation view of a method and a portion of an apparatus for forming a convolute package of flexible foam sheet material in accordance with the present invention;

The present invention is described herein with reference to the densification or compaction of an elongate web of flexible foam sheet material, such as polyurethane, other similar open cellular foam material, or other material having a similar low density and a high degree of compressiblity. Polyurethane foam is conventionally made in large blocks by reacting a polyisocyanate with a polyol based polyester or polyether. Carbon dioxide gas is generated during the reaction, which causes the reaction mixture to foam and thereby form the cellular structure. Also, a propellant, such as Freon, may be used to reinforce the foaming action. The resulting block of foam is then turned down on a peeler in much the same manner as a lathe, to produce an elongate thin sheet or web having a thickness which typically ranges between one-quarter to one inch or more. If desired, a fabric or scrim may be laminated to one or both faces of the web to provide additional strength. Next, the web is loosely wound into large rolls to facilitate the handling thereof prior to further processing, for example, by cutting the web into components used in the fabrication of seat cushions, mattresses and the like. Where the roll must be stored or shipped prior to further processing, it is common to compress or compact the roll by one of the several methods noted above in order to reduce its volume and thereby facilitate shipment and storage.

Figure 1:
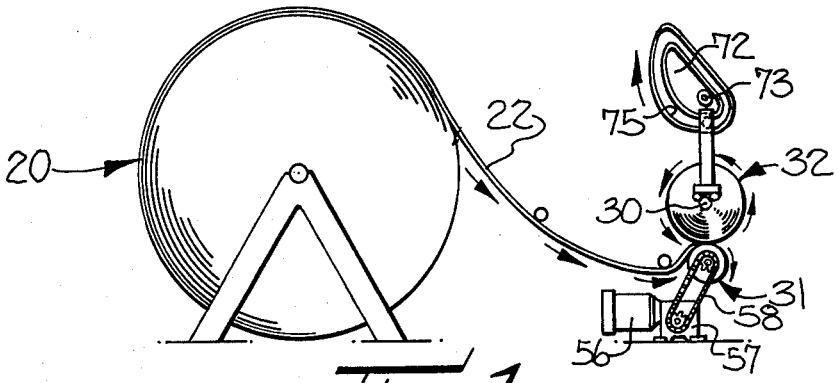

FIG. 1 schematically illustrates a method and apparatus in accordance with the present invention and which is adapted to form a highly compact, convolute package from a web of flexible foam sheet material. In particular, the numeral 20 represents a large supply roll which comprises a web of the sheet material 22 which is typically loosely wound into the roll 20 as it leaves the laminator, and which may have a diameter of about 8 feet.

Figure 3:
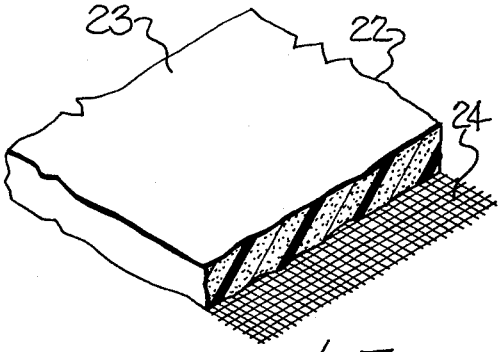
FIG. 3 is an enlarged fragmentary perspective view of a flexible foam sheet material which may be employed in the present invention, and illustrating the same in an unwound, non-compacted condition.
Figure 4:
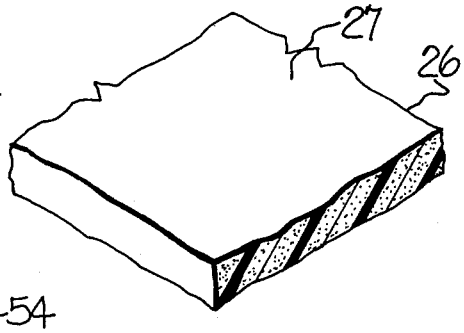
FIG. 4 is a view similar to FIG. 3 but illustrating a different embodiment of the foam sheet material and which does not include a reinforcing scrim.

FIG. 3 illustrates the foam sheet material 22 of the roll 20 in its relaxed, unwound or flat condition. More particularly, the material 22 comprises a cellular foam layer or sheet 23 and a layer or sheet 24 of reinforcing material secured to and overlying one face thereof. The reinforcing material 24 typically comprises a fabric, such as lightweight cotton or polyester scrim which is bonded to one face of the foam, by means of either a conventional adhesive or a flame laminating process or the like. FIG. 4 illustrates another embodiment of a foam sheet material 26 suitable for use with the present invention, and which comprises a layer of cellular foam 27 without a reinforcing material. In either embodiment, the sheet material typically has a thickness of between ¼ to 1 inch or more, and a width up to about 60 inches.

From the roll 20, the web of sheet material 22 is advanced along a path of travel and into a nip formed between a take-up roller 30 and a supporting or driving roller 31. In this regard, the sheet material 22 may be advanced by the rotation of the rollers 30, 31, or by a positive feed means along the path of travel, or by a combination of these and/or other similar means. As the web of sheet material passes through the nip, the thickness is reduced by substantially more than one-quarter of its original non-compacted thickness, and preferably by at least about one-half its original thickness. After passing through the nip, the web is convolutely wound upon the take-up roller 30 to form a wound package 32 thereon, while maintaining substantially the same degree of compression in the web. By controlling the separation of the rollers 30, 31 as hereinafter further described, a substantially uniform layer to layer compression is achieved in the layers 33 of the package 32.

The apparatus of the present invention is illustrated in more detail in FIGS. 7 through 14, and comprises a frame 34 which includes four vertically directed supports 35, 36, 37, 38 extending upwardly from the floor, and four horizontal members 39, 40, 41, 42 extending between the vertical supports to form a box-like structure. A pair of uprights 43, 44 extend upwardly from the sides of the apparatus, and support an overhead framework 45 which includes a longitudinally directed beam 46, 47 on each side of the apparatus, and a transverse interconnecting beam 48. Also, the rear end of the frame mounts a pair of upwardly inclined braces 50, 51 for the purposes set forth below.

The uprights 43, 44 are each positioned in longitudinal alignment with one of the supports 36, 37 at the forward end of the apparatus, and are spaced therefrom to define a vertical guide slot 52 therebetween. As will be more fully described below, the guide slots 52 are designed to receive the take-up roller 30 therebetween, and permit the take-up roller to freely rotate and vertically lift during the winding operation.

The supporting or driving roller 31 is rotatably mounted on the frame for rotation about a fixed horizontal axis which is positioned below and in alignment with the guide slots 52, and such that the guide slots extend in a direction perpendicular to the axis of the roller 31. The roller 31 has a substantially uniform diameter throughout its length, and in the illustrated embodiment, it has a rubber-like outer surface 54 (FIG. 2) to facilitate frictional engagement with the sheet material, and has an outer diameter of about 6 ½ inches throughout its length. The roller 31 is rotatably driven by a variable speed direct current electric motor 56, which acts through a gear reduction device 57 and the interconnecting chain and sprocket arrangement 58.

The take-up roller 30 comprises a steel rod 59 of substantially uniform outer diameter of about 1 ¾ inches throughout its length, and a cylindrical core 60 (FIG. 2) of paperboard or the like, and which has an outer diameter of about 2 ¼ inches, is loosely and coaxially disposed over the rod. As noted above, the ends of the roller 30 are initially disposed within the guide slots 52 such that the take-up roller rests upon the surface of the supporting roller 31. The rotation of the supporting roller is thereby imparted to the take-up roller 30 and the package 32 being wound thereupon, such that a flexible foam sheet material or the like may be directed into the nip formed between the rollers and wound upon the take-up roller 30, and the rollers 30, 31 may separate as the package 32 builds upon the take-up roller.

In accordance with the present invention, the distance between the rollers 30, 31 is controlled to a predetermined amount during the winding of the package upon the take-up roller to thereby control the compression of the package layers. Preferably, this distance is increased by a constant amount during each rotation of the package such that the rollers separate a constant and predetermined amount which is less than the thickness of the sheet material upon each rotation of the package to thereby achieve a highly compact convolute package having a substantially uniform and predetermined layer to layer compression. By this arrangement, the compression within each layer may be selected within predetermined limits consistent with the desired compression of the overall package and without risk of detrimental overcompression of any layers.

The above control means includes a pair of hold down brackets 65 disposed over and engaging the ends of the take-up roller 30. More particularly, each bracket 65 includes a pair of spaced bearings 66 for contacting the roller while permitting the free rotation thereof, and each bracket 65 is slideably mounted to the frame 34 by means of a pair of vertically disposed guide rods 68, 69 carried on each side of the apparatus, note FIG. 7. Thus the brackets 65 and take-up roller 30 may vertically lift from the supporting roller 31 as the package 32 builds.

The above control means further includes a pair of cams 71, 72 rotatably mounted on the frame, with each cam being positioned above one of the hold down brackets 65. More particularly, the two cams 71, 72 are mounted for rotation with a rod 73 which defines a common axis and which is parallel to the axis of the supporting roller 31. In addition, the two cams 71, 72 have conforming cam outlines 74, 75, respectively, with each outline comprising an inwardly facing U-shaped endless channel. A linkage is operatively positioned between each of the cam outlines 74, 75 and the associated hold down brackets 65, whereby the cam outlines control the speed at which the take-up roller 30 is permitted to move upwardly. Each linkage comprises a cam follower 78 positioned within the cam outline of the associated cam, an upper bracket 79 slideably mounted on the guide rods 68, 69 and fixedly mounting the follower 78, and a pneumatic cylinder 80 interconnecting the upper bracket 79 and the hold down bracket 65. The cylinder 80 includes an internal piston (not shown) and connecting rod 81, and the piston is adapted to be selectively positioned by means of a suitable pneumatic control (not shown) between an extended position (FIGS. 9–11) wherein the hold down bracket 65 is lowered, and a retracted position (FIG. 7) wherein the hold down bracket is raised. By this arrangement, the hold down brackets 65 may be selectively lowered in unison to operatively engage the take-up roller 30, and subsequently raised to release its engagement therewith.

Figure 14:
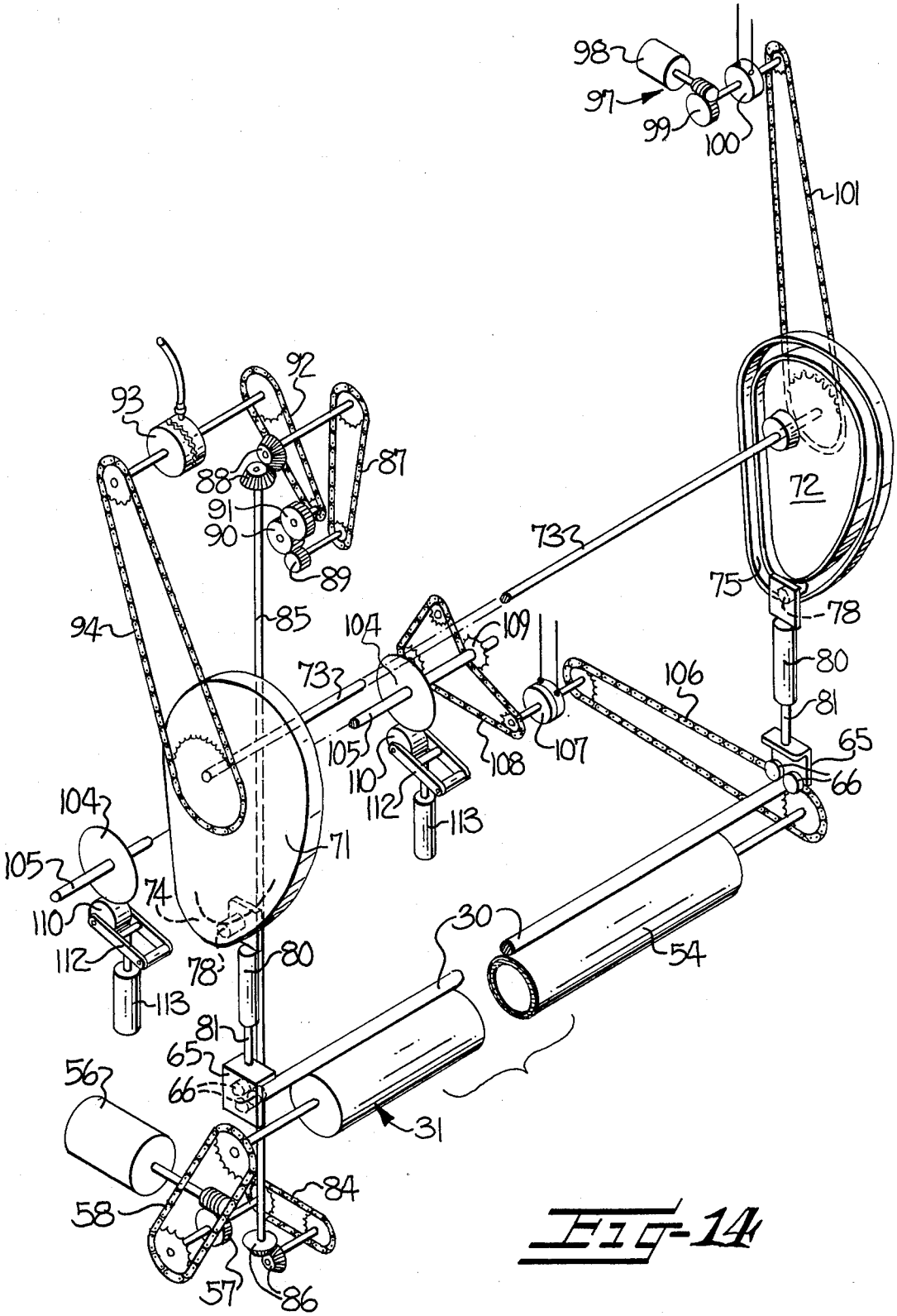
FIG. 14 is a schematic fragmentary perspective view illustrating the apparatus illustrated in FIGS. 7–13.

The rod 73 and cams 71, 72 carried thereby are rotated at a speed coordinated with the speed of rotation of the supporting or driving roller 31. As best seen in FIG. 14, the drive system for the cams includes a chain and sprocket assembly 84 connected to the shaft of the gear reduction device 57, a vertical shaft 85 connected to the assembly 84 through a pair or mating bevel gears 86, a second chain and sprocket assembly 87 connected to the shaft 85 through another pair of mating bevel gears 88, a driven gear 89, a pair of mating speed control gears 90 and 91, a third chain and sprocket assembly 92, and a pneumatically operated clutch 93. A fourth chain and sprocket assembly 94 is positioned on the opposite side of the clutch 93 and is directly connected to the rod 73. By this arrangement, it will be seen that the supporting roller 31 and cams 71, 72 have a common drive source. In addition, the speed control gears 90, 91 are designed to be readily removed and replaced by gears having a different ratio to thereby selectively vary the relative speed of rotation between the cams and the supporting roller. As will become apparent, such a change in relative speed will vary the predetermined distance by which the rollers 30, 31 separate upon each rotation of the take-up roller 30 and package 32, and thus permits a variation in the compression of the web of sheet material in the nip without modification of the outline of the cams 71, 72. Also, a change of the gears 90, 91 permits the apparatus to readily accommodate sheet materials of varying thicknesses.

The apparatus further comprises a separate "quick return" drive means 97 which is operable independently from the drive for the supporting roller and cams. This independent drive means is designed to rapidly rotate the rod 73 and cams 71, 72, and comprises the electric motor 98 which acts through a gear reducer 99, electromagnetic clutch 100, and chain and sprocket assembly 101, to rotate the rod 73. As will be hereinafter further explained, the independent drive means 97 is only engaged when the pneumatic clutch 93 of the primary drive system is disengaged.

Figure 13:
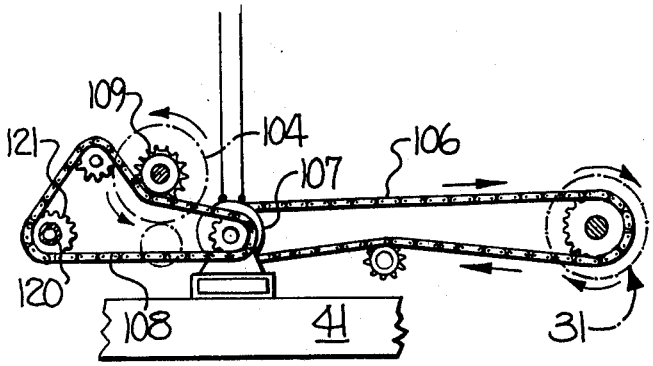
FIG. 13 is a fragmentary transverse section taken substantially along the line 13—13 of FIG. 9.

The apparatus of the present invention further includes a pair of spaced circular trimming knives 104 carried on the transverse rod 105 for the purpose of trimming the edges of the sheet material to achieve a predetermined width dimension prior to entering the nip of the rollers 30 and 31. The rod 105 carrying the knives is rotatably driven by an arrangement which is best seen in FIGS. 13 and 14, and which includes a chain and sprocket assembly 106 connected to the roller 31, an electromagnetic clutch 107, and another chain and sprocket assembly 108 connected to the opposite side of the clutch 107. The sprocket 109 on the rod 105 operatively engages the chain of the assembly 108 and is rotated in the manner illustrated in FIG. 13. The trimming knives 104 have a diameter substantially corresponding to that of the roller 31, and thus the peripheral speed of the knives closely corresponds to that of the supporting roller.

Figure 12:
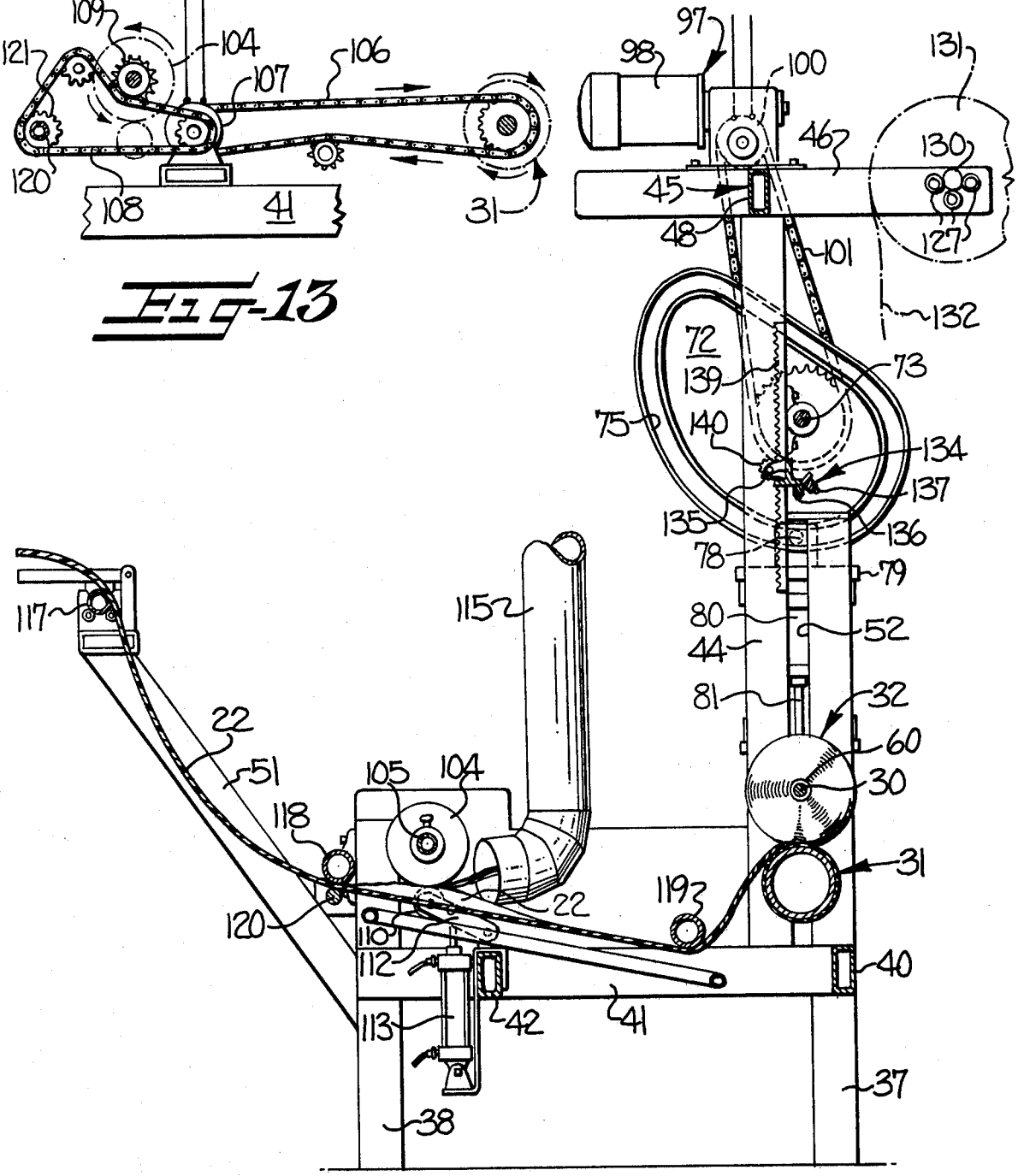
FIG. 12 is a transverse section taken substantially along the line 12—12 of FIG. 9.

The knives 104 are adapted to be adjustably positioned at various locations along the length of the rod 105 to accommodate sheet materials of varying widths, and a back-up roller 110 is positioned in association with each knife to facilitate the cutting of the advancing web therebetween. As best seen in FIG. 12, each back-up roller 110 is pivotally mounted on a bracket 112, which in turn is carried by the horizontal member 42 of the frame. A pneumatic cylinder 113 is also associated with each back-up roller 110 for selectively biasing the roller into an upper operative position or a lower retracted position. The latter position is adapted to facilitate the initial threading of the sheet material therethrough.

Also, the brackets 112 of each back-up roller are slideable along the horizontal member 42 to permit lateral adjustment and thereby insure proper alignment with the associated knife. A vacuum chute 115 is positioned adjacent each of the nips formed by the knives 104 and back-up rollers 110 to remove the severed edge portions of the advancing sheet material.

The sheet material 22 in the supply roll 20 is adapted to be advanced and guided into the nip formed between the supporting roll 30 and take-up roller 31 by an arrangement which includes a guide roller 117 rotatably carried at the remote end of the inclined braces 50, 51, a second rotatable transverse guide roll 118, and a third guide roll 119 positioned immediately upstream and below the nip. A positively rotated rod 120 is disposed in spaced relation below the guide roll 118, the rod 120 being operatively connected to the sprocket 121 of the chain and sprocket assembly 108 so as to be rotated thereby and thus facilitate the advance of the sheet material along its path of travel.

In order to permit the length of sheet material which has been wound into the package to be monitored by the operator of the apparatus, there is provided a yardage measuring device 124 of conventional design which is mounted along one side of the apparatus. The device includes a wheel 125 positioned for rolling contact on the advancing sheet material, and an odometer 126 for visually indicating the length thereof.

The forward end of each of the longitudinally directed beams 46, 47 on the overhead framework 45 mounts three roller bearings 127 on the inwardly facing surface thereof as best seen in FIG. 12. The bearings serve to rotatably mount the shaft 130 of a roll 131 of thermoplastic wrapping material 132 or the like to thereby permit the wrapping material to be readily withdrawn therefrom and wound about the wound package 32 on the take-up roller. Also, the transverse beam 48 of the overhead framework mounts an assembly 134 for selectively heat sealing the layers of the wrapping material 132 together to thereby secure the same about the wound package. More particularly, the heat sealing assembly 134 comprises a horizontal, transverse bar 135 disposed above the rollers 30 and 31, and which includes a pair of electrically heated wires 136, 137 along the lower surface thereof (note FIG. 12). A vertically directed guiding rack 139 is mounted on each of the uprights 43, 44, and the bar 135 carries a mating gear 140 at each end such that the bar 135 may vertically slide along the racks 139 with the gears 140 maintaining the horizontal alignment of the bar 135. The bar is selectively reciprocated donwardly to effect the heat sealing operation by means of a pneumatic cylinder 142 carried by the beam 48.

The sequence for the operation of the apparatus disclosed in FIGS. 7–14 to wind a highly compact, convolute package 32 in accordance with the present invention, will now be described. Initially, the hold down brackets 65 are lifted to their raised position by means of the pneumatic cylinders 80. The take-up roller 30 and coaxially disposed cardboard core 60 are then inserted into the apparatus such that the ends of the roller are positioned in the guide slots 52 and rest upon the supporting roller 31. The sheet material 22 is then directed into the nip, and the forward end of the material is turned upon the roller 30 a couple of times by hand. The hold down brackets 65 are then shifted to their lowered position, where they rest upon the ends of the roller 30. At this lowered position, the cams 71, 72 are in the position shown in FIG. 10, such that the followers 78 are on the low point of the cam outlines.

To commence the winding operation, the clutch 93 is engaged to interconnect the cams 71, 72 with the drive of the supporting roller 31, and the clutch 100 of the quick return drive 97 is disengaged. Also, the clutch 107 is engaged to permit rotation of the trimming knives 104 and the rod 120. The electric motor 56 is then energized to commence the rotation of the supporting roller 31 and the cans 71, 72. As will be apparent from FIG. 10, the slope of the cam outlines 74, 75 is more steep along its initial portion, and it gradually becomes less steep. By design, this predetermined slope permits the hold down brackets 65 to move upwardly a constant predetermined distance upon each rotation of the take-up roller 30 and the package 32 formed thereon. The constant predetermined distance is less than the thickness of the sheet material, such that the hold down brackets 65 resist the upward movement of the roller 30, and thereby exert a downwardly directed force at each end thereof which serves to compress the sheet material as it passes through the nip. More particularly, the thickness of the sheet material is reduced by substantially more than one-quarter of its original non-compacted thickness, and preferably by at least about one-half of its original thickness. Thus for example, where a one-half inch thick web of foam sheet material is being wound, the rollers are preferably designed to separate a fixed distance of about one-quarter inch upon each rotation of the package, to thereby reduce the thickness of the web by one-half.

Viewing FIG. 12, it will be seen that the advancing web of sheet material is introduced onto the package at the nip, which is located inside of the peripheral outline of the wound package by a distance represented at 144. Thus the radius R1 of the package at the nip is less than the radius R2 of the remaining periphery of the package, and the web is introduced into the nip and is initially brought into contact with the periphery of the package at point inside of the radius R2. This reduction in radius at the nip results from the fact that the package is depressed across the width thereof at the nip by maintaining the periphery of the package in continuous and forceable contact with the supporting roller 31.

As the web of sheet material 22 passes through the nip, the thickness is reduced as noted above, and after passing through the nip, the advancing web is convolutely wound open the take-up roller 30 to form a wound package 32 thereon, while maintaining substantially the same degree of compression in the web. In view of the fact that the web is advanced into the nip with a substantial absence of longitudinal tension, the sheet material is not elongated or stretched in the longitudinal direction upsteam of the nip. Thus upon entering the nip, the web is in a condition wherein its length, width and thickness dimensions closely correspond to these same dimensions when the web is in a fully relaxed, non-compacted form. Since the length and width dimensions are believed to be unchanged when the web is passed through the nip and wound onto the take-up roller for the reasons noted below, these dimensions in the layers of the resulting convolute package will substantially correspond to the original length and width dimensions of the web. Further, the web is seen to be subjected to a certain amount of circumferential tension upon leaving the nip and moving from the radius R1 to radius R2, and it is believed that this circumferential tension in each of the convolute layers 48 helps to retain the compaction of the layers and contributes to the above noted self-restrained nature of the package.

When winding a sheet material 22 of the construction shown in FIG. 3, it is preferable that the sheet material be guided into the nip such that the scrim 24 contacts the supporting roller 31 and is positioned on the outer face of each layer in the wound package. In such position, it is believed that the scrim contributes at least to some degree in maintaining the above described circumferential tension upon the wound layers.

The application of an equal force at each end of the roller 30 in accordance with the present invention, results in a substantially uniform compressive force along the length of the nip. In this regard, the fact that the supporting roller 31 has a substantially uniform outer diameter throughout its length and thereby presents a non-interrupted line of contact along the full length of the nip results in a substantially uniform, continuous reduction in the thickness of the web across the web across its full width as it passes through the nip. Thus a significantly higher degree of compression may be achieved as compared, for example, with the above described prior art apparatus having grooved rollers.

Figure 11:
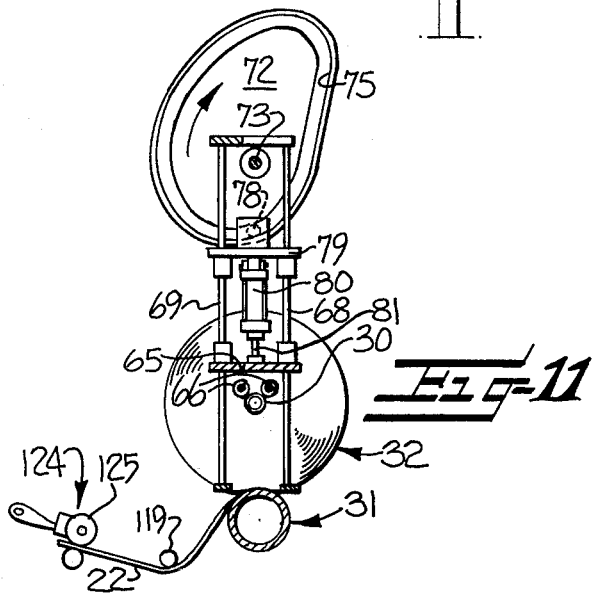
FIG. 11 is a view similar to FIG. 10 and illustrating the apparatus at the completion of the winding operation.

During the winding operation, the cams 71, 72 travel through approximately 180° to the position shown in FIG. 11, and when the desired final size is reached (as determined, for example, by the yardage counter 124), the motor 56 is manually stopped and the sheet material 22 severed upstream of the nip. Where it is desired to wrap the wound package, the thermoplastic wrapping material 132 is withdrawn from the roll 131, and wound about the package. In such case, the clutch 107 may be disengaged, and the motor 56 energized to cause the roller 30 and package 32 to rotate a couple turns to facilitate the placement of the wrapping material about the package. The heating bar 135 is then reciprocated into contact with the overlapping layers of the wrapping material to heat seal the same together. In this regard, the lowermost wire 136 of the heating bar is designed to heat seal the layers of wrapping material together, while the other wire 137 is designed to sever the wrapping material.

To remove the wound package 32, the pneumatic cylinders 80 are activated to lift the hold down brackets 65 to their raised position and thereby release the ends of the roller 30. The rod 59 may then be pulled axially through one of the guide slots 52 and from the core 60, and the package 32 then lowered from the supporting roller 31.

In order to quickly return the cams 71, 72 to their original position, the clutch 93 is disengaged and the clutch 100 is engaged. The motor 98 is then energized which, by design, quickly rotates the rod 73 and cams 71, 72 clockwise as seen in FIG. 11. When the starting position is reached, the operator disengages the motor 98, re-engages the clutch 93, and disengages the clutch 100.

Figure 2:
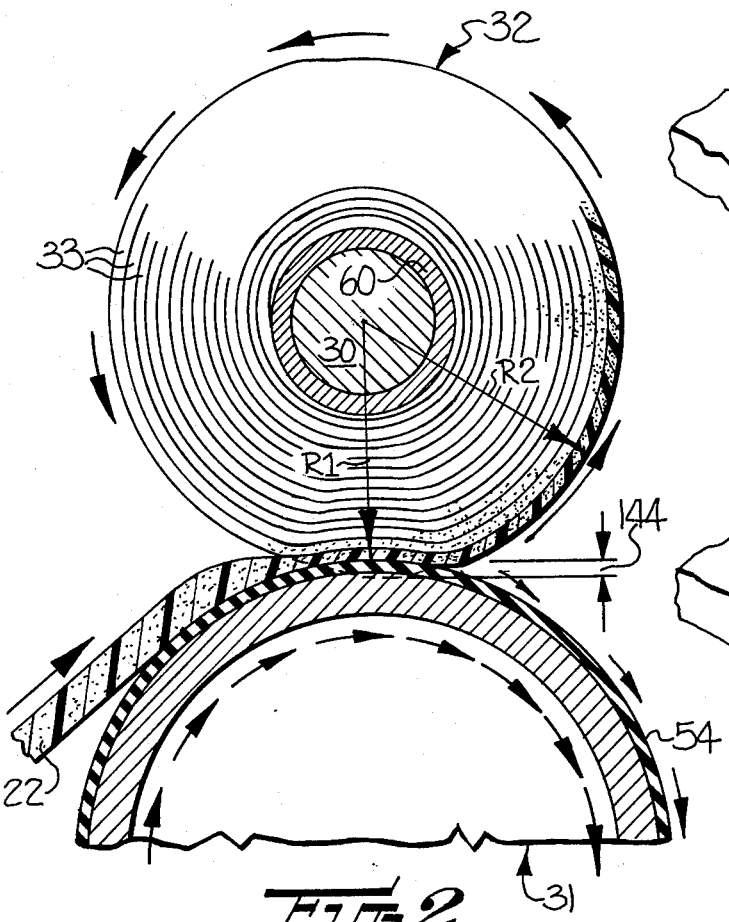
FIG. 2 is a transverse section of the take-up roller and supporting roller as shown in FIG. 1, and illustrating the manner in which the foam sheet material is compressed and wound upon the take-up roller.
Figure 5:
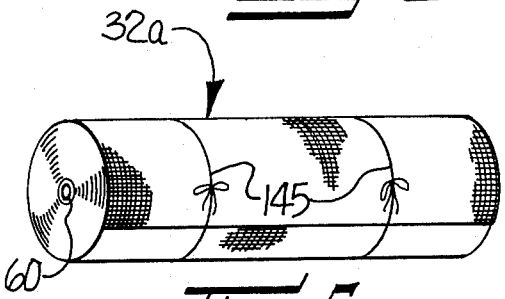
FIG. 5 is a schematic perspective view of a convolute package formed in accordance with the present invention.
Figure 6:
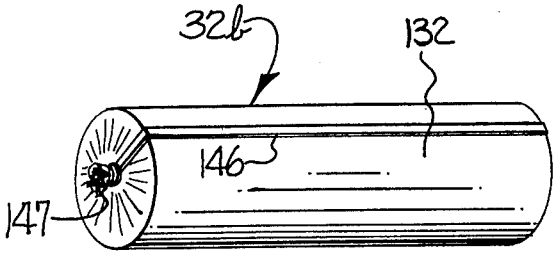
FIG. 6 is a view similar to FIG. 5 but illustrating the package with a thermoplastic sheet wrapper.
Figures 7, 8:
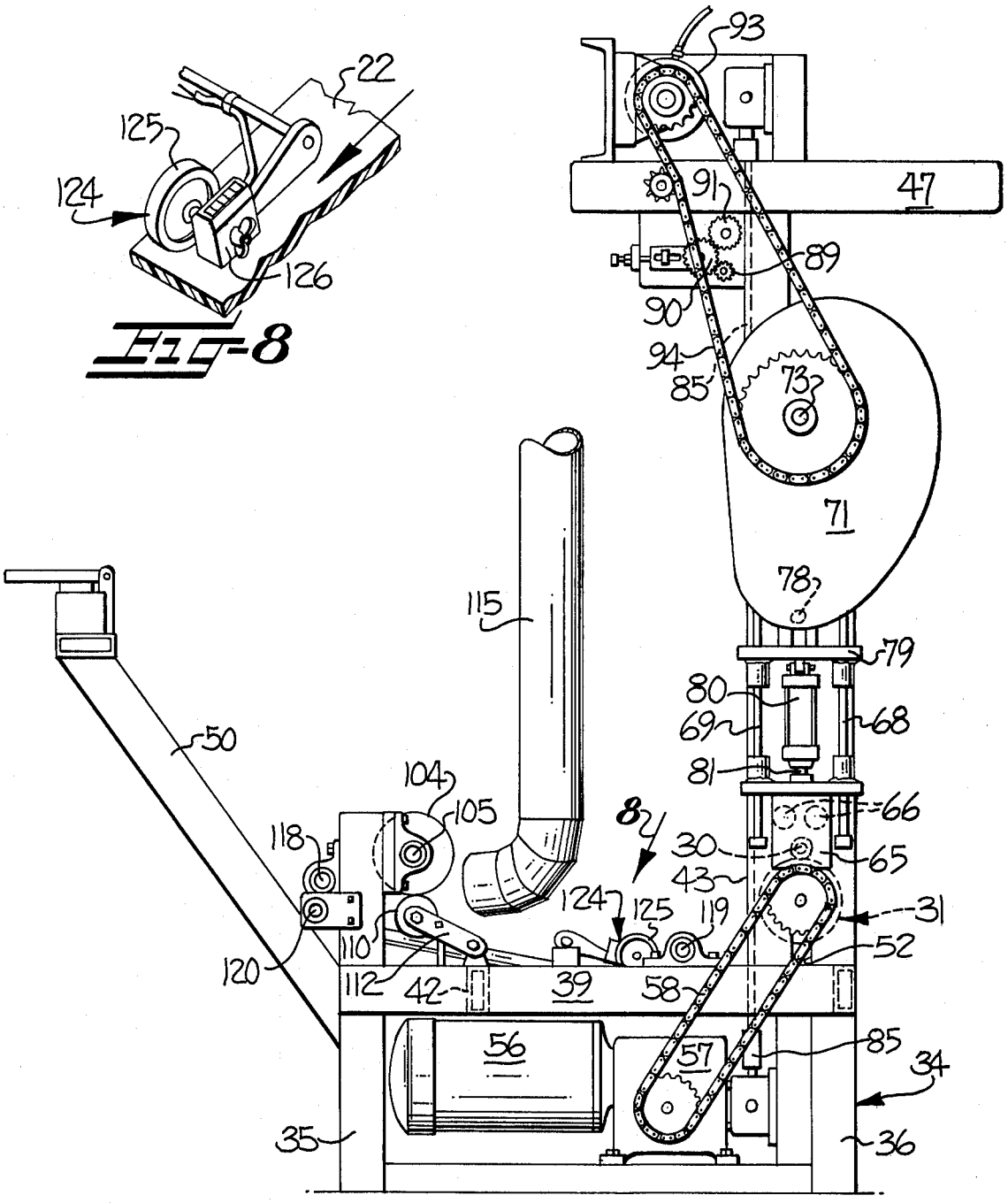
FIG. 7 is a side elevation view of an apparatus embodying the present invention.
FIG. 8 is a fragmentary perspective view taken along the arrow 8 in FIG. 7.
Figure 9:
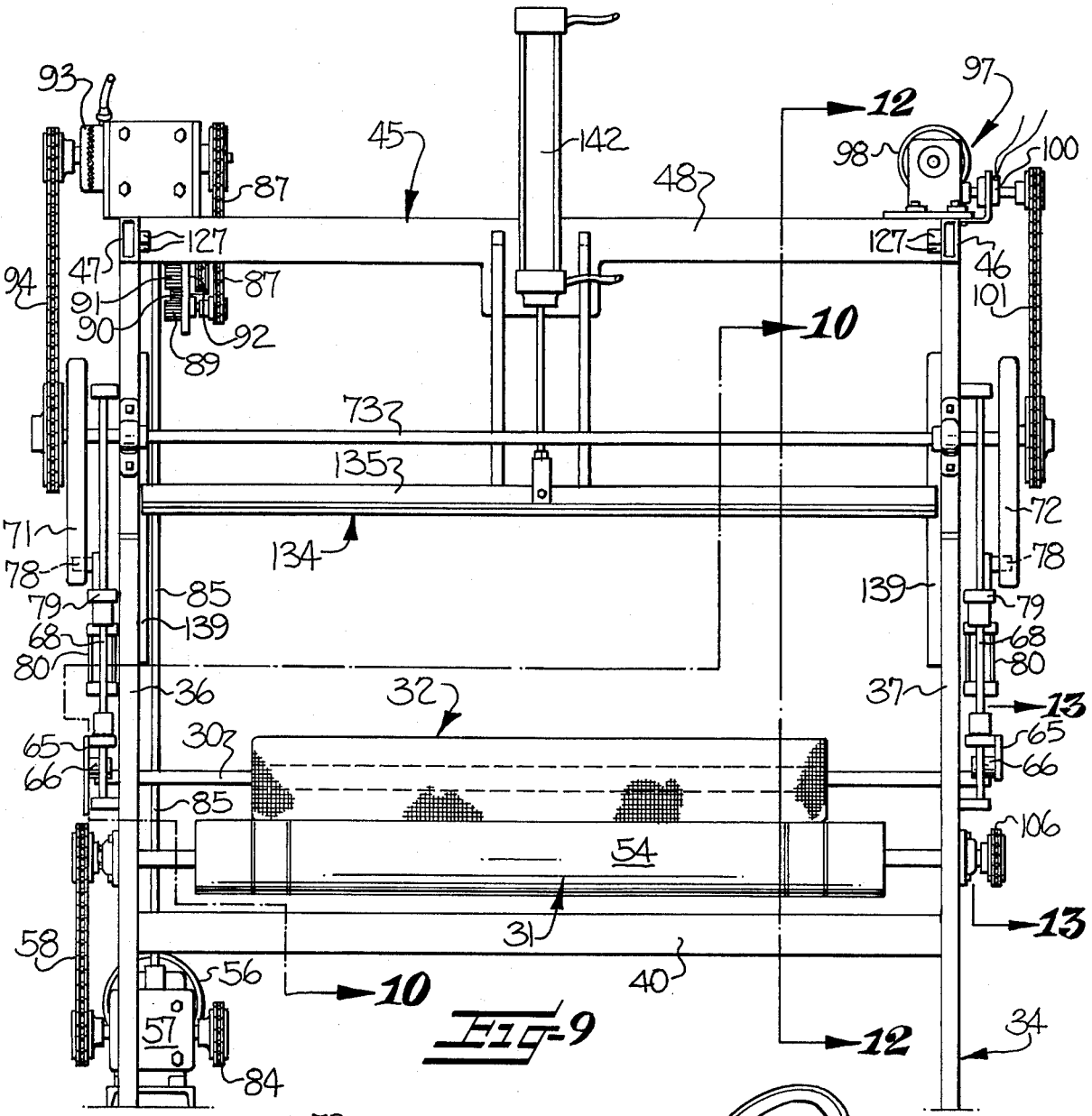
FIG. 9 is a front elevation view of the apparatus shown in FIG. 7, but with the brackets lowered onto the take-up roller.
Figure 10:
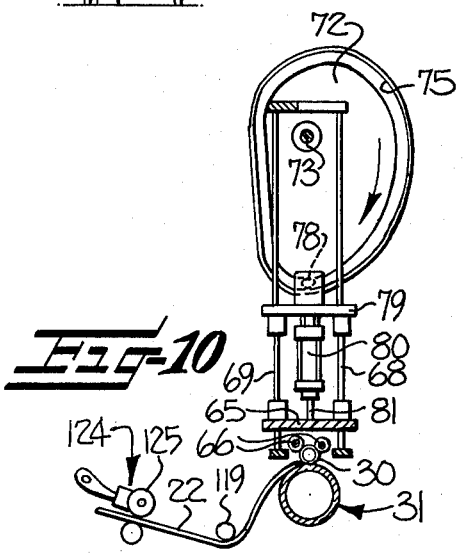
FIG. 10 is a fragmentary and reduced transverse section taken substantially along the line 10—10 of FIG. 9 and illustrating the apparatus at the commencement of the winding operation.

Convolute packages formed in accordance with the present invention are illustrated in FIGS. 5 and 6 at **32*a* and 32*b* respectively. Each of these packages comprises the cylindrical core 60, and a predetermined length of flexible foam sheet material 22 coaxially wound into a plurality of convoluted layers 33 upon the core. The packages 32*a* and 32*b* as illustrated, are made from the sheet material 22 having a thickness of about one-half inch in non-compacted form, a width of about 60 inches, and a length of about 90 yards. In such case, the packages 32*a*, 32*b* will typically have a diameter of about 2 feet. As best seen in FIG. 2, the layers 33** are substantially smooth and wrinkle-free, and the length and width dimensions are substantially unchanged from the length and width dimensions of the sheet material in an unwound, non-compacted form. Thus the sheet material is dimensionally stable in the length and width directions upon the rewinding of the roll, and the above noted problems resulting from the recovery lag of the prior art rolls are eliminated. While the actual length of the sheet material in wound package form is not readily measurable, the above stated belief that it is substantially unchanged from its original length is logically verified by actual measurement immediately upon the unwinding thereof.

The convoluted layers 33 of the packages **32*a* and 32*b* have a thickness substantially less than three-quarters of the thickness of the non-compacted sheet material, and preferably they have a thickness not greater than about one-half the original thickness. Thus the resulting volume of the package will be substantially less than nine-sixteenths of the volume the package would occupy in a non-compacted, wound form, for example, not greater than one-half the non-compacted volume. Preferably however, the resulting volume will be not greater than about one-quarter of such non-compacted volume. In the illustrated embodiment, the layers 33 in the packages 32*a* and 32*b* are about one-half the thickness of the sheet material 22 (i.e., one-quarter inch) and the volume of each of the packages is thus about one-quarter of the volume the packages would occupy in a non-compacted, convolutely wound form. While such a 75% reduction in volume is indeed of material significance in facilitating shipment and storage of the package, a reduction in volume of greater than 85% is readily achievable with the present invention. Further, the external configuration of the packages 32*a* and 32*b* is a substantially uniform cylinder as seen in FIGS. 5 and 6**, to thereby permit the close grouping of a number of such packages and thereby further facilitate shipment and storage.

The package **32*a* as shown in FIG. 5 further comprises a pair of hand tied flexible cords 145 encircling the outer layer of the sheet material for the purpose of securing the outer layer in its wound condition and precluding the unwinding of the package during transmit or storage. Alternatively, the package 32*b* shows the above described sheet of thermoplastic wrapping material 132 for securing the outer layer of the sheet material, the material 132 having been heat sealed along a line 146 by the wire 136 to secure the sheet in position about the package. Also, the edges of the material 132 are gathered over the ends of the package and tied or otherwise secured at 147**, such that the material overlies and protects all surfaces of the package.

The method and package specifically illustrated herein show the winding of the sheet material 22 with a scrim 4, note FIG. 3. It will be understood however that flexible foam sheet materials of other constructions, such as the material 26 (FIG. 4), may be formed into convolute packages with a comparable degree of compaction by the practice of the method of the present invention. Further, the thickness of the foam sheet material which may be employed with the present invention encompasses a rather wide range, but typically the weakness ranges between about one-quarter to one inch or more.

A package produced in accordance with the above described process has been found to exhibit several significant physical characteristics which materially enhance its commercial utility. As more fully discussed above, the package is substantially self-restrained against circumferential expansion and thus does not tend to radially expand upon the release of the binder. Further, the roll does not tend to unwind, either by unrolling along a floor or unwinding in a spring-like fashion, and the recovery lag associated with the compacted rolls of the prior art has been eliminated, thereby permitting immediate use of the web in forming components of predetermined size therefrom.

A further and significant feature of the present invention resides in the fact that each layer in the package is substantially uniformly compressed by reason of the fact that the distance between the rollers is permitted to increase a fixed predetermined distance upon each rotation of the package, and the fact that the separation of the rollers may be accurately controlled to in turn control the degree of compression in each foam layer. This permits packages having a given length of foam sheet material therein to have a substantially consistent outside diameter which is predetermined for optimum packing of a number of packages during shipment or storage. Also, maximum compression of the overall package may be obtained while avoiding variations in compression from layer to layer which could result in areas of detrimental over-compression. As noted above, such over-compression can result in a significant lag in the recovery of the full thickness dimension of the foam sheet material upon unwinding of the package, which in turn can preclude the immediate use of the foam in certain instances. In addition, over-compression can result in destruction of the cellular foam structure, and thus permanent non-uniformity in the thickness and appearance of the foam sheet material after unwinding of the roll.

Another advantageous feature of the present invention resides in the fact that the means for controlling the separation of the rollers is operatively connected to the drive of the supporting roller 31 rather than the take-up roller 30, such that the take-up roller is free of any interconnection with a driving structure and thus it may be readily removed from the apparatus to release the resulting wound package in the manner described above.

In the drawings and specification, there has been set forth a preferred embodiment of the invention, and although specific terms are employed, they are used in a generic and descriptive sense only and not for purposes of limitation.

That which is claimed is:

1. A method of forming a convolute package of flexible foam sheet material, wherein the package is highly compact and self-restrained against circumferential expansion to facilitate handling and unwinding thereof; wherein the package has substantially uniform layer to layer compression within predetermined limits consistent with the desired compression of the overall package and without detrimental over-compression of any layers; and wherein the sheet material in the package is substantially dimensionally stable in the length and width directions so as to permit use of the sheet material, for example, immediately upon the subsequent unwinding thereof in the formation of components of predetermined size, said method comprising the steps of advancing an elongate web of the sheet material along a path of travel and into a nip formed between a take-up roller and a supporting roller, and convolutely winding the advancing web upon the take-up roller to form a wound package thereon, while introducing the advancing web onto the periphery of the package at the nip, maintaining the package radius at the nip less than the radius of the remainder of the package, compressing the web being wound to reduce the thickness thereof by substantially more than one-quarter of its original non-compressed thickness, and controlling the compression of the package layers within said predetermined limits by controlling the distance between the take-up roller and supporting roller to a predetermined amount during each rotation of the package upon the take-up roller.

2. The method as defined in claim 1 wherein the step of controlling the distance between the take-up roller and supporting roller includes increasing the distance by a predetermined amount during each rotation of the package.

3. The method as defined in claim 2 wherein the predetermined amount by which the distance is increased is substantially constant during each rotation of the package.

4. The method as defined in claim 1 wherein the step of compressing the web includes reducing the thickness by at least about one-half of its original non-compressed thickness as the web passes through the nip, and maintaining substantially the same reduction in thickness as the web is wound onto the take-up roller.

5. The method as defined in claim 1 wherein the web is advanced under a substantial absence of longitudinal tension so that the web is not significantly elongated as it is advanced into the nip, and wherein the web is wound upon the take-up roller by rotating the supporting roller to thereby impart rotation to the package.

6. The method as defined in claim 1 wherein the foam sheet material has a thickness of at least about one-quarter inch and further comprises a reinforcing material secured to one face thereof, and the sheet material is advanced into the nip such that the reinforcing material contacts the supporting roller and is thereby positioned on the outer face of each layer in the package being formed.

7. A method of forming a convolute package of flexible foam sheet material, wherein the package is highly compact and self-restrained against circumferential expansion to facilitate handling and unwinding thereof; wherein the package has substantially uniform layer to layer compression within predetermined limits consistent with the desired compression of the overall package and without detrimental over-compression of any layers; and wherein the sheet material in the package is substantially dimensionally stable in the length and width directions so as to permit use of the sheet material, for example, immediately upon the subsequent unwinding thereof in the formation of components of predetermined size, said method comprising the steps of advancing an elongate web of flexible foam sheet material having a thickness of about one-half inch along a path of travel and into a nip formed between a take-up roller and a supporting roller, and convolutely winding the advancing web upon the take-up roller to form a wound package thereon, while introducing the advancing web onto the periphery of the package at the nip, maintaining the package radius at the nip less than the radius of the remainder of the package, compressing the web being wound to reduce the thickness thereof by at least about one-half its original non-compressed thickness, and controlling the compression of the package layers within said predetermined limits by increasing the distance between the take-up roller and supporting roller by about one-quarter inch during each rotation of the package.

8. An apparatus for winding an elongate web of flexible foam sheet material or the like into a highly compact convolute package having substantially uniform layer to layer compression within predetermined limits consistent with the desired compression of the overall package and without detrimental over-compression of any layers, said apparatus comprising a frame, a driving roller and a take-up roller, said take-up roller being adapted to have the web convolutely wound thereon to form a convolute package, means mounting one of said rollers on said frame to define a fixed horizontal axis, means mounting the other of said rollers along a horizontal axis which is parallel to the axis of said one roller and so as to be operationally movable in a direction substantially perpendicular to and away from the axis of said one roller and such that a nip is formed between the periphery of the package being formed on the take-up roller and the driving roller, drive means for rotating said driving roller to thereby impart rotation to the package being formed on the take-up roller and to wind the web onto the package, and such that the rollers separate as the package increases in size, and means operatively connected to said drive means and engageable with the opposite ends of said other roller for controlling the separation of the rollers to a predetermined amount substantially less than the thickness of the web upon each rotation of the package, to thereby control the compression of the package layers and achieve substantially uniform layer to layer compression within said predetermined limits.

9. The apparatus as defined in claim 8 wherein said means for controlling the separation of the rollers comprises hold down bracket means slideably mounted on said frame for operatively engaging the ends of said other roller, cam means having a predetermined cam outline rotatably mounted on said frame, means operatively connected to said drive means for rotating said cam means at a speed coordinated with the speed of rotation of said driving roller, and linkage means operatively positioned between said cam outline of said cam means and said hold down bracket means, whereby said cam outline controls the speed at which said other roller moves away from the axis of said one roller.

10. The apparatus as defined in claim 8 wherein said driving roller has a substantially uniform outer diameter throughout its length to thereby present a non-interrupted line of contact along the full length of the nip and thereby achieve a maximum degree of compression of the web.

11. The apparatus as defined in claim 8 further comprising means mounted on said frame for trimming at least one of the edges of the sheet material to obtain a predetermined width thereof while the sheet material is advanced into the nip formed between the package and driving roller.

12. The apparatus as defined in claim 8 further comprising means mounted on said frame for rotatably supporting a roll of thermoplastic wrapping material or the like to thereby permit the wrapping material to be wound about the wound package, and heating means carried by said frame for selectively heat sealing the layers of the wrapping material together to thereby secure the same about the wound package while on said take-up roller.

13. An apparatus for winding an elongate web of flexible foam sheet material or the like into a highly compact convolute package having substantially uniform layer to layer compression within predetermined limits consistent with the desired compression of the overall package and without detrimental over-compression of any layers, said apparatus comprising a frame, a driving roller and a take-up roller, said take-up roller being adapted to have the web convolutely wound thereon to form a convolute package, means mounting said driving roller on said frame to define a fixed horizontal axis, means mounting said take-up roller along a horizontal axis which is parallel to the axis of said driving roller and so as to be operationally movable in a direction substantially perpendicular to and away from the axis of said driving roller and such that a nip is formed between the periphery of the package being formed on the take-up roller and the driving roller, drive means for rotating said driving roller to thereby impart rotation to the package being formed on the take-up roller and to wind the web onto the package, and such that the rollers separate as the package increases in size, and means operatively connected to said drive means and engageable with the opposite ends of said take-up roller for controlling the separation of the rollers to a predetermined amount substantially less than the thickness of the web upon each rotation of the package, to thereby control the compression of the package layers and achieve substantially uniform layer to layer compression within said predetermined limits and comprising (a) a pair of hold down brackets disposed adjacent the ends of the take-up roller and mounted on said frame for movement along a direction parallel to the direction of movement of said take-up roller, (b) a cam rotatably mounted on said frame in spaced relation with respect to each of said hold down brackets, said cams having conforming cam outlines and being mounted for rotation about a common axis which is parallel to the axis of said driving roller, (c) means operatively connected to said drive means of said driving roller for rotating said cams in unison about said common axis and at a speed coordinated with the speed of rotation of said driving roller, and (d) a linkage operatively positioned between each of said cam outlines and the associated hold down bracket, whereby said cam outlines control the speed at which said take-up roller moves away from the axis of said driving roller.

14. The apparatus as defined in claim 13 wherein each of said linkages includes a cam follower positioned to operatively engage the cam outline of the associated cam, and means for selectively moving the hold down bracket with respect to the cam follower and between an extended position and a retracted position, whereby the hold down bracket may be selectively extended to operately engage said take-up roller and retracted to release its engagement therewith.

15. The apparatus as defined in claim 14 wherein said cam outline of each of said cams comprises a U-shaped channel, and wherein the associated follower is disposed within said channel such that the movement of each follower in both directions is controlled by the associated cam outline.

16. The apparatus as defined in claim 13 further comprising selectively operable means which is independent from said drive means of said driving roller for rapidly rotating said cams in unison about said common axis to thereby rapidly move the hold down brackets to a desired position.

17. The apparatus as defined in claim 13 further comprising means for selectively varying the relative speed of rotation between said cams and said driving roller, whereby the amount by which the rollers separate upon each rotation of the package may be preselected without modification of the cam outlines.

* * * * *

UNITED STATES PATENT AND TRADEMARK OFFICE

CERTIFICATE OF CORRECTION

PATENT NO. : 4,109,443

DATED : August 29, 1978

INVENTOR(S) : Allen Cameron Findlay

It is certified that error appears in the above-identified patent and that said Letters Patent are hereby corrected as shown below:

Column 1, line 2, "impact" should be --compact--;
Column 1, line 39, "its" should be --it--;
Column 1, line 55, "shippeed" should be --shipped--.
Column 3, line 20, "tbhe" should be --the--;
Column 3, line 29, "package" should be --packages--
Column 3, line 67, "th" should be --the--.
Column 8, line 4, "or" should be --of--.
Column 9, line 51, "donwardly" should be --downwardly--.
Column 10, line 10, "cans" should be --cams--;
Column 10, line 32, "Fig. 12" should be --Fig. 2--;
Column 10, line 48, "open" should be --upon--.
Column 11, line 19, delete "across the web";
Column 11, line 52, delete "is".
Column 12, line 7, "rewinding" should be --unwinding--;
Column 12, lines 45 & 46, "transmit" should be --transit--;
Column 12, line 57, "scrim 4" should be --scrim 24--;
Column 12, line 65, "weakness" should be --thickness--.

Signed and Sealed this

*Sixth* Day of *March 1979*

[SEAL]

*Attest:*

RUTH C. MASON
*Attesting Officer*

DONALD W. BANNER
*Commissioner of Patents and Trademarks*